US010562154B2

(12) United States Patent
Maji et al.

(10) Patent No.: US 10,562,154 B2
(45) Date of Patent: Feb. 18, 2020

(54) CUTTING BLADE

(71) Applicant: DISCO CORPORATION, Tokyo (JP)

(72) Inventors: Ryogo Maji, Tokyo (JP); Ryuji Oshima, Tokyo (JP); Yoshiki Ishiai, Tokyo (JP)

(73) Assignee: DISCO CORPORATION, Tokyo (JP)

( * ) Notice: Subject to any disclaimer, the term of this patent is extended or adjusted under 35 U.S.C. 154(b) by 5 days.

(21) Appl. No.: 15/240,586

(22) Filed: Aug. 18, 2016

(65) Prior Publication Data

US 2017/0057054 A1 Mar. 2, 2017

(30) Foreign Application Priority Data

Sep. 2, 2015 (JP) ..... 2015-172664

(51) Int. Cl.
*B24D 5/12* (2006.01)
*B24D 3/06* (2006.01)

(52) U.S. Cl.
CPC ..... *B24D 5/12* (2013.01); *B24D 3/06* (2013.01)

(58) Field of Classification Search
CPC ..... B24D 5/12; B24D 3/06
USPC ..... 451/527, 541, 548
See application file for complete search history.

(56) References Cited

U.S. PATENT DOCUMENTS 4,880,707 A * 11/1989 Kohno ..... B22F 7/06 428/565
5,888,119 A * 3/1999 Christianson ..... B24B 13/01 451/41
6,098,609 A * 8/2000 Ishizuka ..... B24B 5/12 125/13.01
6,200,208 B1 * 3/2001 Andrews ..... B24D 3/06 451/541
6,517,427 B1 * 2/2003 Yoshikawa ..... B24D 5/12 451/544
7,762,872 B2 * 7/2010 Sung ..... B24B 7/228 451/527
8,721,392 B2 * 5/2014 Brown ..... B24B 9/102 451/43
2005/0101237 A1 * 5/2005 Vecchiarelli ..... B24D 3/348 451/548
2010/0000159 A1 * 1/2010 Walia ..... B24D 3/06 51/296
2011/0132184 A1 * 6/2011 Ras ..... C04B 35/52 89/36.02
2013/0252522 A1 * 9/2013 Kasashima ..... B24D 5/02 451/548

FOREIGN PATENT DOCUMENTS

JP 2012-056012 3/2012
JP 2012056012 A * 3/2012

OTHER PUBLICATIONS

Machine Translation of JP 2012056012 A, Mar. 2012, Ryogo Umaji.*

* cited by examiner

*Primary Examiner* — Timothy V Eley
(74) *Attorney, Agent, or Firm* — Greer Burns & Crain Ltd.

(57) ABSTRACT

Disclosed herein is a cutting blade including diamond abrasive grains and boron compound grains. The average grain size of the diamond abrasive grains falls within the range of 5 μm to 50 μm. The average grain size of the boron compound grains is greater than ⅕ and less than or equal to ½ of the average grain size of the diamond abrasive grains.

7 Claims, 5 Drawing Sheets

CUTTING BLADE

BACKGROUND OF THE INVENTION

Field of the Invention

The present invention relates to a cutting blade for use in cutting a workpiece.

Description of the Related Art

There is a description that in cutting a substrate formed of a hard brittle material (e.g., quartz or ceramics) to be used for semiconductor fabrication, a good result can be obtained by using a cutting blade including a boron compound (see Japanese Patent Laid-open No. 2012-056012). A boron compound has excellent solid lubricity. Accordingly, by adding a boron compound to a cutting blade, a cutting resistance can be reduced in cutting a workpiece by using the cutting blade, so that the generation of cutting heat at a point of cutting can be suppressed and the wearing of the cutting blade can be suppressed.

Further, in order to efficiently relieve the cutting heat generated in cutting a workpiece from the workpiece to the cutting blade, SiC or GC (green silicon carbide) having high heat conductivity is mixed as a filler into the cutting blade in the prior art.

SUMMARY OF THE INVENTION

However, even in the case of cutting a workpiece formed of a hard brittle material by using the cutting blade including a boron compound, the size of chipping generated from the edges of each division line on the back side of the workpiece cannot be sufficiently reduced. Further, since the improvement both in cutting quality and in productivity is required, the high solid lubricity of the cutting blade must be maintained to more suppress the generation of cutting heat in cutting the workpiece and thereby to more suppress the wearing of the cutting blade.

It is therefore an object of the present invention to provide a cutting blade which can suppress the generation of chipping in cutting a workpiece and can also suppress the wearing of the cutting blade, wherein the cutting blade includes a boron compound and the workpiece is formed of a hard brittle material.

In accordance with an aspect of the present invention, there is provided a cutting blade including diamond abrasive grains and boron compound grains, wherein the average grain size of the diamond abrasive grains falls within the range of 5 μm to 50 μm; and the average grain size of the boron compound grains is greater than ⅕ and less than or equal to ½ of the average grain size of the diamond abrasive grains.

Preferably, the diamond abrasive grains and the boron compound grains are fixed by a resin bond or a metal bond. Preferably, the boron compound grains are selected from the group consisting of boron carbide ($B_4C$) grains and cubic boron nitride (cBN) grains.

In the cutting blade according to the present invention, the average grain size of the boron compound grains to the average grain size of the diamond abrasive grains is controlled, that is, the ratio in average grain size of the boron compound grains to the diamond abrasive grains is controlled. Accordingly, the chipping generated on the back side of the workpiece in cutting the workpiece can be suppressed and the wear amount of the cutting blade can also be suppressed.

The above and other objects, features and advantages of the present invention and the manner of realizing them will become more apparent, and the invention itself will best be understood from a study of the following description and appended claims with reference to the attached drawings showing a preferred embodiment of the invention.

DETAILED DESCRIPTION OF THE PREFERRED EMBODIMENT

Figure 1:
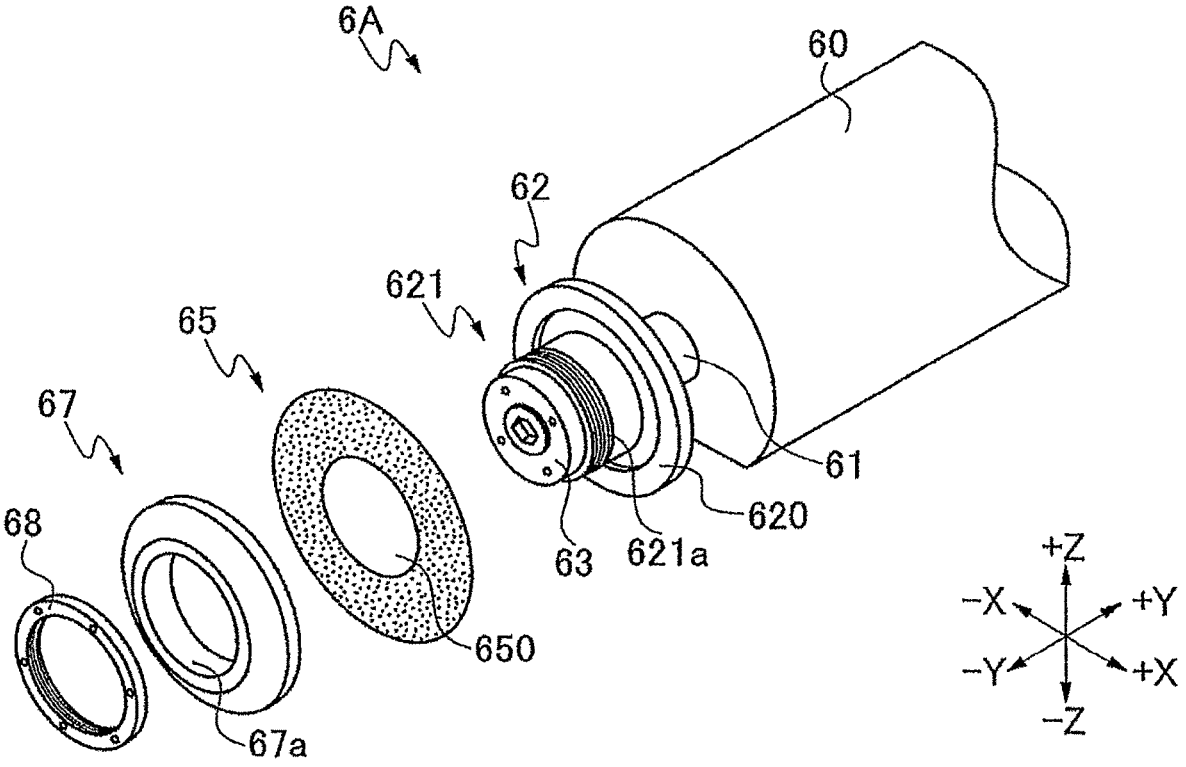
FIG. 1 is an exploded perspective view of a spindle unit including a cutting blade according to a preferred embodiment of the present invention.

Referring to FIG. 1, a cutting blade 65 is shown. For example, the cutting blade 65 is a washer type resin bond blade having an annular shape. The cutting blade 65 is formed by fixing diamond abrasive grains and grains of $B_4C$ (boron carbide) as a boron compound with a resin bond such as phenol resin. In the cutting blade 65, the diamond abrasive grains function as main abrasive grains and the $B_4C$ grains function as auxiliary abrasive grains.

For example, the cutting blade 65 is manufactured by the following method. First, diamond abrasive grains having an average grain size of 45 μm and $B_4C$ grains having an average grain size of 15 μm are mixed in an amount of 10 vol. % to 20 vol. % for each to a resin bond composed mainly of phenol resin, epoxy resin, or polyimide resin, and then stirred to obtain a mixture. Thereafter, this mixture is pressed to form an annular member having a predetermined thickness (e.g., 150 μm in Example 1). Thereafter, the annular member is sintered at 180° C. to 200° C. for seven to eight hours to manufacture the cutting blade 65 having a mounting hole 650 shown in FIG. 1. As the boron compound, cBN (cubic boron nitride) may be used in place of $B_4C$. The average grain size of the boron compound grains may be suitably changed in the range of greater than ⅕ to less than or equal to ½ of the average grain size of the diamond abrasive grains, more preferably in the range of greater than ⅕ to less than or equal to ⅓ of the average grain size of the diamond abrasive grains. Further, the volume ratio between the diamond abrasive grains and the boron compound grains may be suitably changed in the range of 2:1 to 1:8. Further, the diamond abrasive grains may be partially coated with metal such as nickel. Further, carbon may be added as a conductive material in an amount of several % to the cutting blade 65.

The cutting blade 65 is not limited to the annular washer type resin bond blade, but it may be a hub type cutting blade formed by integrating a base (hub) and a cutting edge, wherein the base is formed of cast aluminum alloy, for example. In this case, the cutting edge is composed of a resin bond, diamond abrasive grains, and $B_4C$ grains.

As the bond for fixing the diamond abrasive grains and the boron compound grains, a metal bond may be used in place of the resin bond. For example, an annular washer type metal bond blade may be manufactured by the following method. First, a metal bond is prepared by mixing minute amounts of cobalt and nickel into bronze, or an alloy of copper and tin as a principal component. Then, diamond abrasive grains having an average grain size of 45 μm and $B_4C$ grains having an average grain size of 15 μm are mixed in an amount of 10 vol. % to 20 vol. % for each to the metal bond prepared above, and then stirred to obtain a mixture. Thereafter, this mixture is kneaded and pressed to form an annular member having a predetermined thickness. Thereafter, the annular member is sintered at 600° C. to 700° C. for about one hour to manufacture the annular washer type metal bond blade. Both in the case of using the resin bond and in the case of using the metal bond, the average grain size of the diamond abrasive grains should be set to 5 μm or more, so as to prevent a problem such that the amount of projection of the diamond abrasive grains may be too small to cut a workpiece.

Referring to FIG. 1, a spindle unit 6A is shown. The spindle unit 6A includes a spindle housing 60 and a spindle 61 rotatably supported in the spindle housing 60. The axis of the spindle 61 extends in the direction (Y direction) perpendicular to the X direction in a horizontal plane. A front end portion of the spindle 61 projects from the spindle housing 60 in the direction shown by an arrow −Y. A mount flange 62 for mounting the cutting blade 65 is fixed to this projecting portion of the spindle 61 by means of a nut 63. The mount flange 62 includes a flange portion 620 extending outward in a radial direction (direction perpendicular to the axial direction of the spindle 61) and a boss portion 621 projecting from the flange portion 620 in its thickness direction (Y direction), the boss portion 621 having an external thread 621*a* on the outer circumferential surface.

After the boss portion 621 of the mount flange 62 is inserted through the mounting hole 650 of the cutting blade 65, a detachable flange 67 is mounted on the boss portion 621. The detachable flange 67 has an engaging hole (through hole) 67*a* corresponding to the boss portion 621. That is, the engaging hole 67*a* of the detachable flange 67 is adapted to engage the boss portion 621. After the detachable flange 67 is mounted on the boss portion 621, a ring nut 68 is threadedly engaged with the external thread 621*a* of the boss portion 621, thereby axially pressing the detachable flange 67 toward the flange portion 620. Accordingly, the cutting blade 65 is tightly held between the detachable flange 67 and the mount flange 62 from the opposite sides in the Y direction. Thusly, the cutting blade 65 is firmly mounted through the mount flange 62 to the spindle 61. The spindle 61 is rotationally driven by a motor (not shown) to thereby rotate the cutting blade 65 at a high speed.

Figure 2:
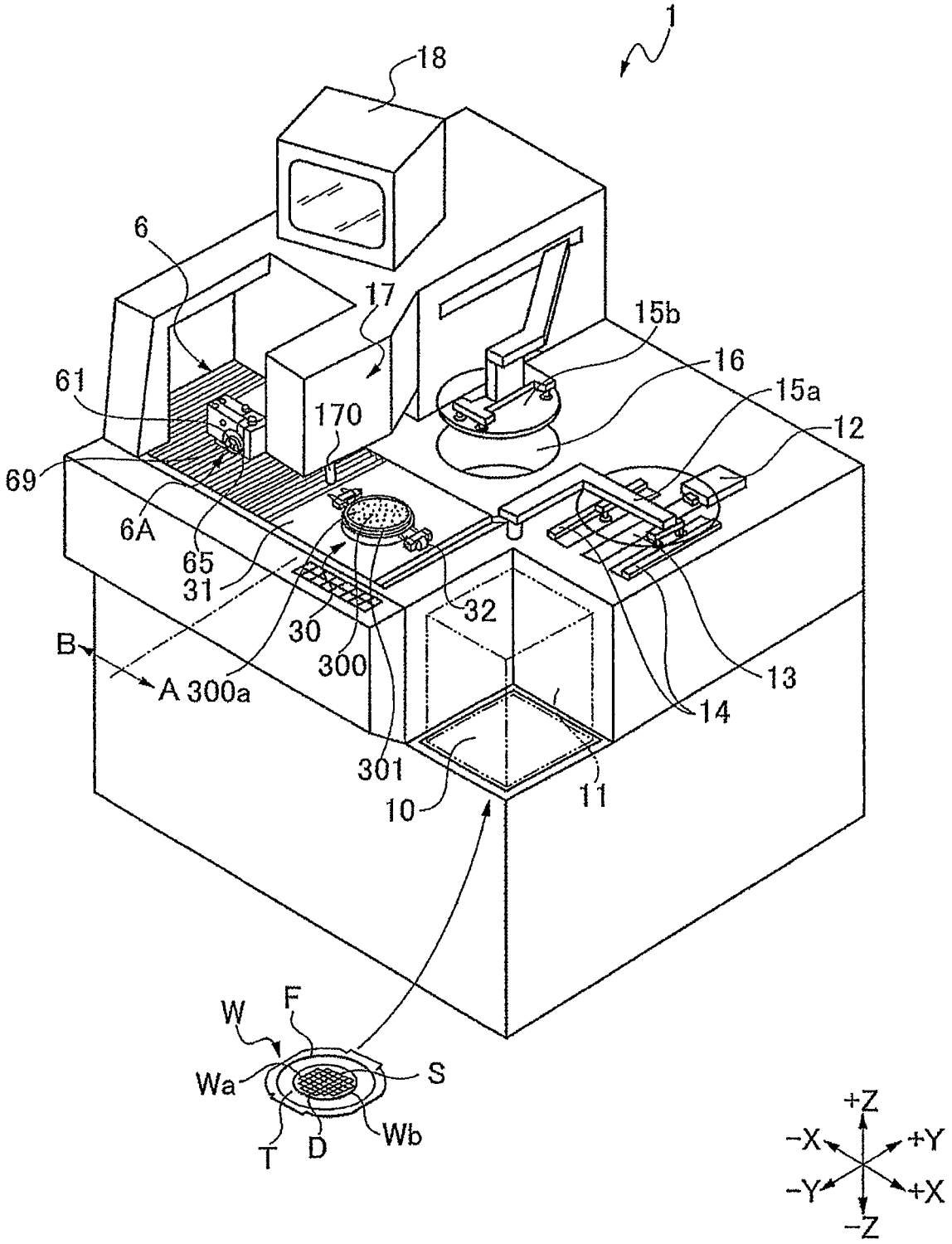
FIG. 2 is a perspective view of a cutting apparatus including the spindle unit shown in FIG. 1.

Referring to FIG. 2, a cutting apparatus 1 is shown. The cutting apparatus 1 includes a chuck table 30 for holding a workpiece W and cutting means 6 having the cutting blade 65 shown in FIG. 1 for cutting the workpiece W held on the chuck table 30. The cutting means 6 shown in FIG. 2 is movable in the Y direction by Y moving means or indexing means (not shown) and also movable in the Z direction by Z moving means or cutter feeding means (not shown).

An elevating mechanism 10 is provided at a front end portion (−Y side) of the cutting apparatus 1 so as to be movable in the Z direction. A cassette 11 is placed on the upper surface of the elevating mechanism 10. A plurality of workpieces W each supported through a dicing tape T to an annular frame F are stored in the cassette 11. Handling means 12 is provided on the rear side (+Y side) of the cassette 11 to take one of the workpieces W out of the cassette 11 before cutting or to return the workpiece W into the cassette 11 after cutting. A temporary placement area 13 for temporarily placing the workpiece W before cutting or after cutting is provided between the cassette 11 and the handling means 12 in its original position shown in FIG. 1. In the temporary placement area 13, there is provided positioning means 14 for positioning the workpiece W temporarily placed.

First transfer means 15*a* is provided in the vicinity of the temporary placement area 13 to transfer the workpiece W between the chuck table 30 and the temporary placement area 13. The first transfer means 15*a* is so configured as to hold the workpiece W under suction, whereby the workpiece W to be cut is held under suction and then transferred from the temporary placement area 13 to the chuck table 30.

Cleaning means 16 for cleaning the workpiece W after cutting is provided in the vicinity of the first transfer means 15*a*. Further, there is provided above the cleaning means 16 second transfer means 15*b* for transferring the workpiece W from the chuck table 30 to the cleaning means 16 after cutting. The second transfer means 15*b* is also configured so as to hold the workpiece W under suction.

The chuck table 30 is circular in outside shape, and it includes a suction holding portion 300 for holding the workpiece W under suction and a frame member 301 for supporting the suction holding portion 300. The suction holding portion 300 has a holding surface 300*a* as an exposed surface communicating with a vacuum source (not shown), wherein the workpiece W is held on the holding surface 300*a* under suction. The chuck table 30 is surrounded by a cover 31. The chuck table 30 is rotatable about its axis extending in the Z direction by any rotating means (not shown). Further, two clamping means 32 for clamping the annular frame F are provided around the chuck table 30.

The chuck table 30 is reciprocatively movable in the X direction by X moving means or work feeding means (not shown) provided under the cover 31, between a standby area A where the workpiece W is held on the chuck table 30 before cutting or is upheld from the chuck table 30 after cutting and a cutting area B where the workpiece W is cut by the cutting means 6. There is provided above a moving path of the chuck table 30 alignment means 17 for detecting division lines S formed on the front side Wa of the workpiece W, wherein the division lines S are to be cut by the cutting blade 65. The alignment means 17 includes imaging means 170 for imaging the front side Wa of the workpiece W and can detect the division lines S to be cut according to an image obtained by the imaging means 170. The image obtained by the imaging means 170 is displayed on display means 18 such as a monitor.

The cutting means 6 for cutting the workpiece W held on the chuck table 30 is provided in the cutting area B in the vicinity of the alignment means 17. The cutting means 6 and the alignment means 17 are integrated and they are movable together in the Y direction and the Z direction. The cutting means 6 includes the spindle unit 6A having the cutting blade 65 and also includes a cutting water nozzle 69 for supplying a cutting water to a contact position between the cutting blade 65 and the workpiece W.

There will now be described with reference to FIG. 2 the operation of the cutting apparatus 1 and the operation of the cutting means 6 in the case of cutting the workpiece W by using the cutting blade 65. The workpiece W to be cut by the cutting apparatus 1 is a quartz substrate, for example. The front side Wa of the workpiece W is partitioned into a plurality of separate regions by the crossing division lines S, and a plurality of devices D are respectively formed in these separate regions. The back side Wb of the workpiece W is attached to the adhesive surface of the dicing tape T at its central portion, and the peripheral portion of the dicing tape T is attached to the annular frame F. Thus, the workpiece W is supported through the dicing tape T to the annular frame F. The workpiece W is not limited to such a quartz substrate, but it may be a borosilicate glass substrate or a ceramics substrate such as an alumina substrate.

First, the handling means 12 is operated to take one of the plural workpieces W out of the cassette 11 to the temporary placement area 13, wherein each workpiece W is supported through the dicing tape T to the annular frame F. In the temporary placement area 13, the workpiece W is positioned by the positioning means 14. Thereafter, the workpiece W is held under suction by the first transfer means 15*a* and then transferred from the temporary placement area 13 to the chuck table 30. Thereafter, the annular frame F is clamped by the clamping means 32, and the workpiece W is held under suction through the dicing tape T on the holding surface 300*a*. Thus, the workpiece W is held by the chuck table 30.

After holding the workpiece W on the chuck table 30, the X moving means (not shown) is operated to move the chuck table 30 holding the workpiece W in the direction of the arrow −X from the standby area A to the cutting area B. During the movement of the chuck table 30, the imaging means 170 is operated to image the front side Wa of the workpiece W, thereby detecting the division lines S to be cut. At the same time, the Y moving means (not shown) is operated to move the cutting means 6 in the Y direction, thereby aligning the cutting blade 65 with a target one of the division lines S extending in a first direction.

Thereafter, the X moving means (not shown) is operated again to further move the chuck table 30 in the direction of the arrow −X. At the same time, the Z moving means (not shown) is operated to lower the cutting means 6 in the direction of the arrow −Z. Further, the spindle 61 is rotated at a high speed by the motor (not shown) to thereby rotate the cutting blade 65 fixed to the spindle 61 at the high speed. Accordingly, the cutting blade 65 rotating at the high speed is relatively fed along the target division line S, thereby cutting the workpiece W along the target division line S.

When the workpiece W is fed to reach a predetermined position in the X direction where the cutting of the target division line S by the cutting blade 65 is ended, the feeding of the workpiece W is once stopped and the Z moving means is operated to raise the cutting blade 65 from the workpiece W. Thereafter, the chuck table 30 is moved in the direction of the arrow +X until reaching the original position where the cutting of the target division line S by the cutting blade 65 has been started. Thereafter, the cutting blade 65 is sequentially indexed in the Y direction by the pitch of the division lines S to similarly cut the workpiece W along all of the other division lines S extending in the first direction.

(Test 1)

In Test 1, the workpiece W (quartz substrate) was fully cut at a feed speed of 5 mm/second and at a feed speed of 20 mm/second by using the cutting blade 65 shown in FIG. 1. The cutting blade 65 is composed of diamond abrasive grains having an average grain size of 45 μm and $B_4C$ grains having an average grain size of 15 μm mixed in an amount of 10 vol. % to 20 vol. % for each to a resin bond (this cutting blade 65 will be hereinafter referred to as "cutting blade 65 as Example 1"). Further, as comparison, a conventional cutting blade was used to fully cut the workpiece W (quartz substrate) at a feed speed of 5 mm/second and at a feed speed of 20 mm/second. The conventional cutting blade used is an annular washer type resin bond blade including diamond abrasive grains only as the abrasive grains, i.e., excluding boron compound grains. The average grain size of the diamond abrasive grains constituting the conventional cutting blade is 45 μm.

In diamond abrasive grains and cBN abrasive grains having a grain size greater than #325, the grain size is determined by the sieve classification method defined by JIS (Japanese Industrial Standards) B4130. In Test 1, diamond abrasive grains having a grain size of 45 μm (to #320) determined by this sieve classification method were used as the diamond abrasive grains having an average grain size of 45 μm. In abrasive grains having a grain size less than #325, the grain size is determined by a laser diffraction and scattering method, for example.

Figure 3:
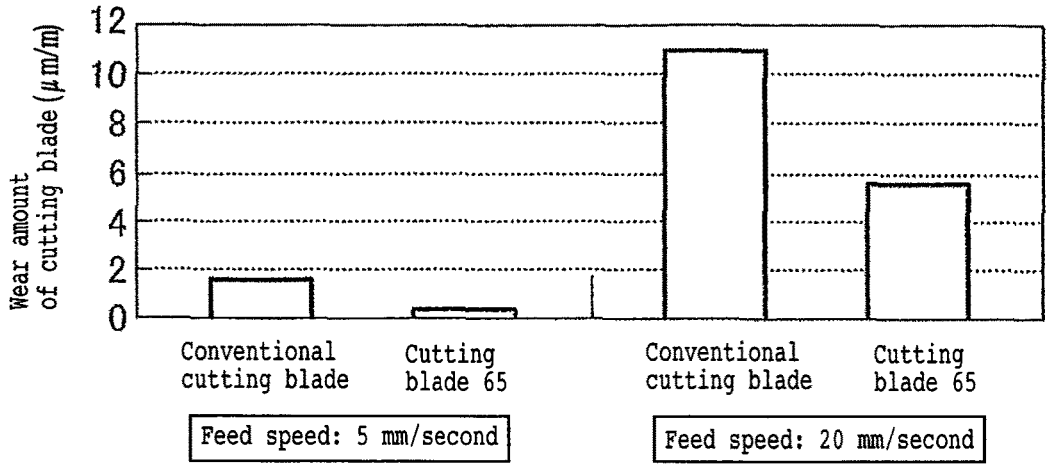
FIG. 3 is a graph showing the relation between the feed speed of a workpiece and the wear amount of a cutting blade in the case of cutting the workpiece by using a cutting blade as Example 1 according to the present invention and a conventional cutting blade.

As apparent from the graph shown in FIG. 3, the following results were confirmed. In the case of cutting the workpiece W at a feed speed of 5 mm/second, the wear amount (vertical axis of the graph) of the conventional cutting blade per unit cut distance is about 1.6 μm/m, whereas the wear amount of the cutting blade 65 as Example 1 per unit cut distance is about 0.4 μm/m. Accordingly, the wear amount of the cutting blade 65 as Example 1 is suppressed in comparison with the wear amount of the conventional cutting blade. Further, in the case of cutting the workpiece W at a feed speed of 20 mm/second, the wear amount (vertical axis of the graph) of the conventional cutting blade per unit cut distance is about 11 μm/m, whereas the wear amount of the cutting blade 65 as Example 1 per unit cut distance is about 5.6 μm/m. Accordingly, also in this case, the wear amount of the cutting blade 65 as Example 1 is suppressed in comparison with the wear amount of the conventional cutting blade. In summary, the wear amount of the cutting blade 65 as Example 1 is suppressed in comparison with the wear amount of the conventional cutting blade irrespective of the feed speed.

Figure 4:
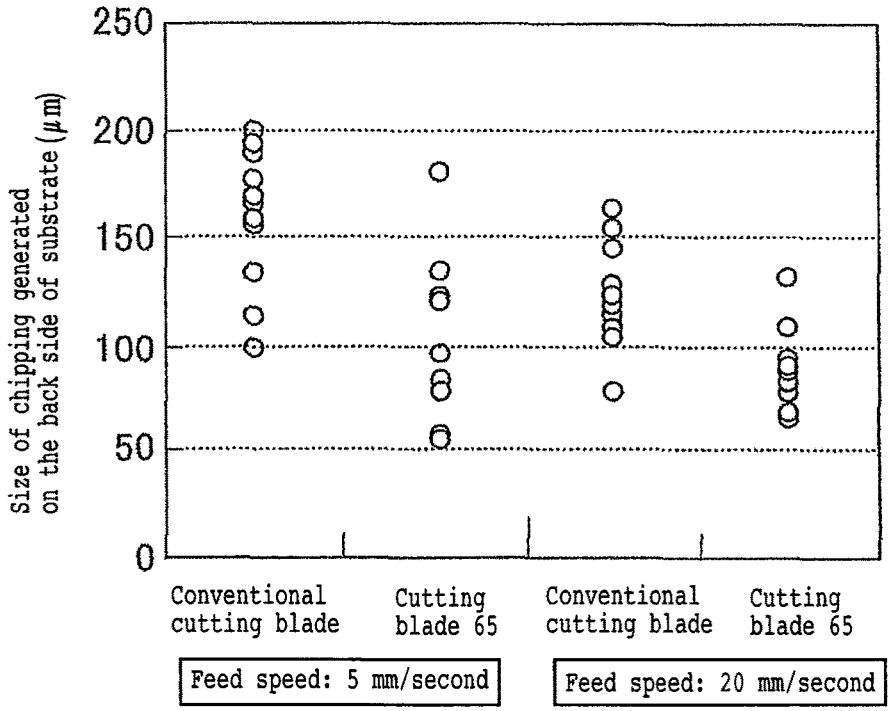
FIG. 4 is a graph showing the relation between the feed speed of the workpiece and the size of chipping generated on the back side of the workpiece in the case of cutting the workpiece by using the cutting blade as Example 1 and the conventional cutting blade.

Further, as apparent from the graph shown in FIG. 4 (the vertical axis of the graph represents the size of chipping), the following results were confirmed. In the case of cutting the workpiece W at a feed speed of 5 mm/second, the size of chipping (the width of chipping) generated on the back side Wb of the workpiece W in the case of using the conventional cutting blade falls within the range of about 100 μm to about 200 μm and concentrates in the range of about 155 μm to about 175 μm. On the other hand, in the case of using the cutting blade 65 as Example 1 at a feed speed of 5 mm/second, the size of chipping generated on the back side Wb of the workpiece W falls within the range of about 60 μm to about 180 μm and concentrates in the range of about 55 μm to about 100 μm. Accordingly, the size of chipping in the case of using the cutting blade 65 as Example 1 at a feed speed of 5 mm/second is smaller than that in the case of using the conventional cutting blade.

Further, in the case of cutting the workpiece W at a feed speed of 20 mm/second, the size of chipping in the case of using the conventional cutting blade falls within the range of about 75 μm to about 170 μm and concentrates in the range of about 100 μm to about 135 μm. On the other hand, in the case of using the cutting blade 65 as Example 1 at a feed speed of 20 mm/second, the size of chipping falls within the range of about 70 μm to about 135 μm and concentrates in the range of about 70 μm to about 90 μm. Accordingly, also in this case, the size of chipping in the case of using the cutting blade 65 as Example 1 at a feed speed of 20 mm/second is smaller than that in the case of using the conventional cutting blade. In summary, the chipping generated on the back side Wb of the workpiece W in the case of using the cutting blade 65 as Example 1 can be suppressed in comparison with the chipping in the case of using the conventional cutting blade irrespective of the feed speed.

Figure 5:
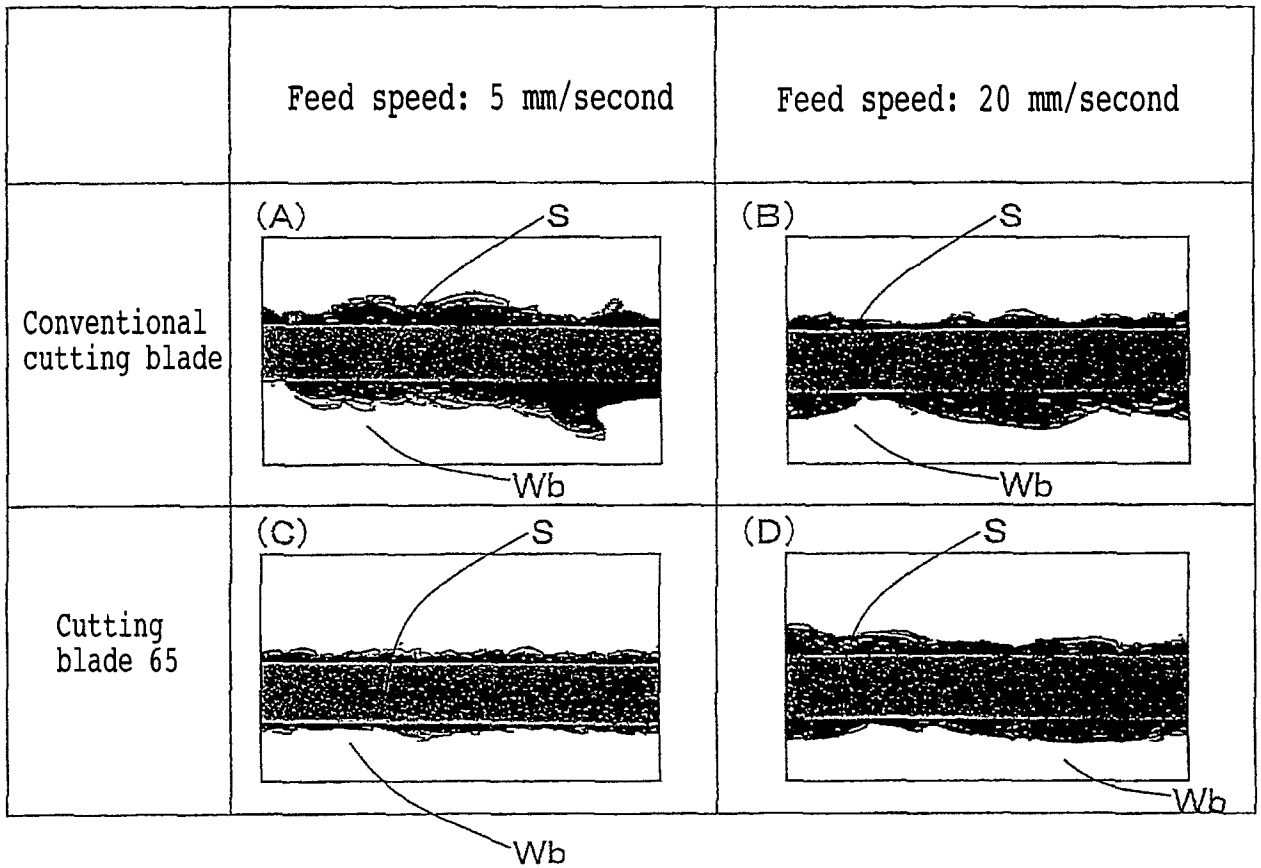
FIG. 5 is a table showing the relation between the feed speed of the workpiece and the size of chipping (microscope photograph) generated on the back side of the workpiece in the case of cutting the workpiece by using the cutting blade as Example 1 and the conventional cutting blade.

This result can also be confirmed from the Table of microscope photographs shown in FIG. 5, wherein the microscope photographs were obtained by imaging the back side Wb of the workpiece W. More specifically, in comparing the microscope photograph (A) (corresponding to the case of using the conventional cutting blade at a feed speed of 5 mm/second) and the microscope photograph (C) (corresponding to the case of using the cutting blade 65 as Example 1 at a feed speed of 5 mm/second), it is confirmed that the width of chipping generated from the edges of the division line S observed in the microscope photograph (C) is smaller than the width of chipping observed in the microscope photograph (A). Similarly, in comparing the microscope photograph (B) (corresponding to the case of using the conventional cutting blade at a feed speed of 20 mm/second) and the microscope photograph (D) (corresponding to the case of using the cutting blade 65 as Example 1 at a feed speed of 20 mm/second), it is confirmed that the width of chipping generated from the edges of the division line S observed in the microscope photograph (D) is smaller than the width of chipping observed in the microscope photograph (B).

In summary, it was confirmed in Test 1 that by adding boron compound grains ($B_4C$ grains) to diamond abrasive grains in making a cutting blade, the wear amount of the cutting blade can be suppressed and the chipping generated on the back side of the workpiece can also be suppressed.

(Test 2)

Figure 6:
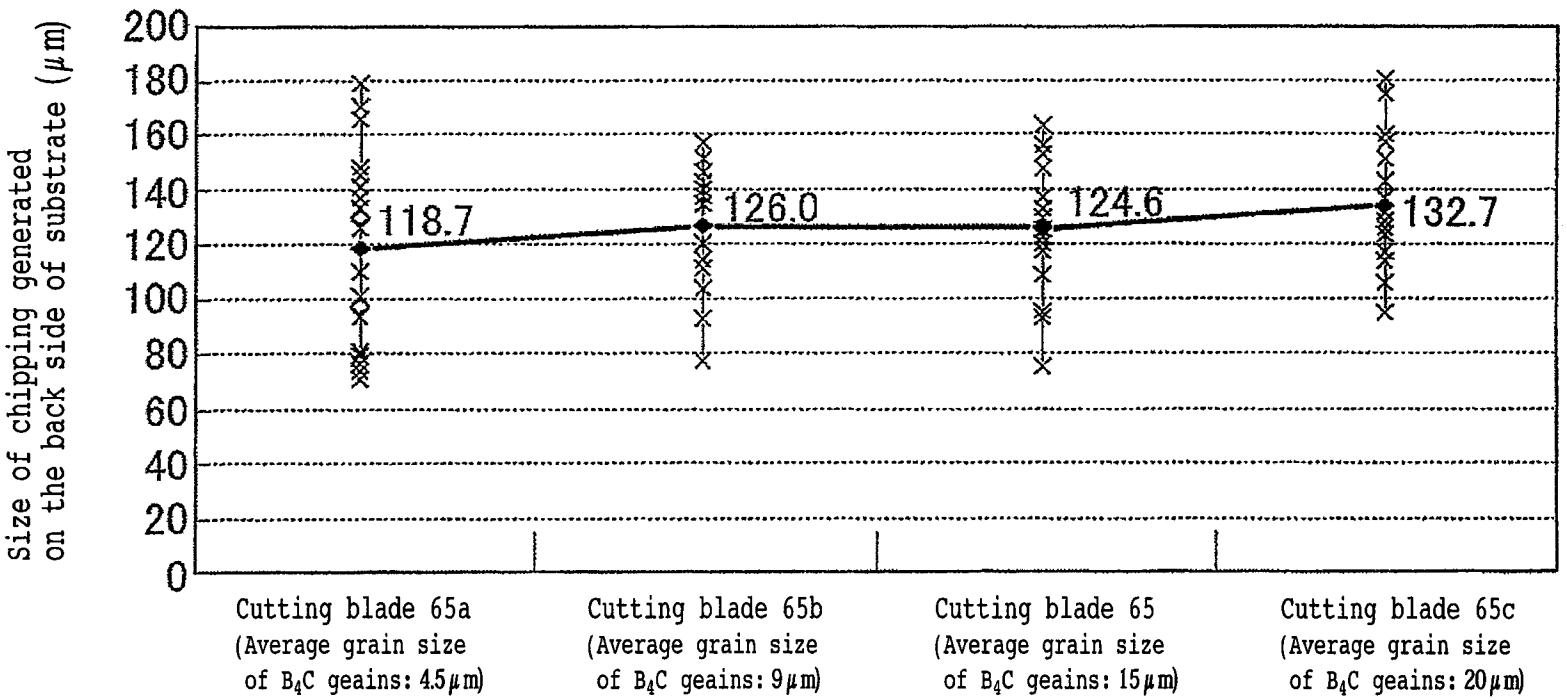
FIG. 6 is a graph showing the relation between the average grain size of $B_4C$ grains and the size of chipping generated on the back side of the workpiece in the case of cutting the workpiece by using the cutting blade as Example 1, a cutting blade as comparison, a cutting blade as Example 2 according to the present invention, and a cutting blade as Example 3 according to the present invention.

In Test 2, as shown in FIG. 6, the workpiece W (borosilicate glass substrate) was fully cut at a fixed feed speed by using the cutting blade 65 as Example 1, a cutting blade 65*a* as comparison, a cutting blade 65*b* as Example 2, and a cutting blade 65*c* as Example 3. The cutting blade 65*a*, the cutting blade 65*b* as Example 2, and the cutting blade 65*c* as Example 3 are different from the cutting blade 65 as Example 1 in only the average grain size of the $B_4C$ grains, and the other configuration is the same as that of the cutting blade 65 as Example 1. More specifically, the average grain size of the $B_4C$ grains included in the cutting blade 65*a* is 4.5 μm, which is about 1/10 of the average grain size (45 μm) of the diamond abrasive grains. The average grain size of the $B_4C$ grains included in the cutting blade 65*b* is 9 μm, which is about 1/5 of the average grain size (45 μm) of the diamond abrasive grains. The average grain size of the $B_4C$ grains included in the cutting blade 65*c* is 20 μm, which is about 4/9 (less than or equal to 1/2) of the average grain size (45 μm) of the diamond abrasive grains. While the average grain size of the diamond abrasive grains included in each cutting blade is 45 μm, the average grain size of the diamond abrasive grains may fall within the range of 5 μm to 50 μm. For example, the average grain size of the $B_4C$ grains included in the cutting blade 65*b* may become greater than 1/5 of the average grain size (45 μm) of the diamond abrasive grains. As described above, in diamond abrasive grains and cBN abrasive grains having a grain size greater than #325, the grain size is determined by the sieve classification method defined by JIS B4130. In Test 2, diamond abrasive grains having a grain size of 45 μm (to #320) determined by this sieve classification method were used as the diamond abrasive grains having an average grain size of 45 μm. In abrasive grains having a grain size less than #325, the grain size is determined by a laser diffraction and scattering method, for example.

As apparent from the graph shown in FIG. 6 (the vertical axis of the graph represents the size of chipping), the size of chipping generated on the back side Wb of the workpiece W in the case of using the cutting blade 65*a* widely varies in the range of about 70 μm to about 180 μm. On the other hand, the size of chipping in the case of using the cutting blade 65*b* as Example 2 falls within the range of about 80 μm to about 160 μm and concentrates in the range of about 125 μm to about 140 μm. Further, the size of chipping in the case of using the cutting blade 65 as Example 1 falls within the range of about 75 μm to about 165 μm and concentrates in the range of about 120 μm to about 125 μm. Further, the size of chipping in the case of using the cutting blade 65*c* as Example 3 falls within the range of about 90 μm to about 180 μm and concentrates in the range of about 120 μm to about 160 μm. Accordingly, all of the cutting blade 65 as Example 1, the cutting blade 65*b* as Example 2, and the cutting blade 65*c* as Example 3 are superior to the cutting blade 65*a* as comparison in that variations in chipping size are suppressed and the chipping size also concentrates in allowable range.

Although not shown, the wear amount of the cutting blade per unit cut distance could be suppressed in all of the cutting blade 65 as Example 1, the cutting blade 65*b* as Example 2, and the cutting blade 65*c* as Example 3.

In summary, it was confirmed in Test 2 that by controlling the average grain size of the boron compound grains to the average grain size of the diamond abrasive grains (by controlling the ratio in average grain size of the boron compound grains to the diamond abrasive grains), the chipping generated on the back side Wb of the workpiece W in cutting the workpiece W can be suppressed and the wear amount of the cutting blade can also be suppressed.

In general, the feed speed of the workpiece W can be increased by increasing the grain size of diamond abrasive grains. Further, the wear rate of the cutting blade 65 can also be reduced by increasing the grain size of diamond abrasive grains. When the wear rate of the cutting blade 65 is increased, origin point setting (setup) of the cutting blade 65 must be frequently performed to make the depth of cut constant, causing a reduction in productivity. Accordingly, it is required to reduce the wear rate of the cutting blade 65. However, when the grain size of diamond abrasive grains is increased to thereby increase the feed speed of the workpiece W, the size of chipping generated on the back side Wb of the workpiece W is increased. Accordingly, the grain size of abrasive grains usable and the feed speed of the workpiece are determined according to an allowable chipping size.

Conventionally, diamond abrasive grains having a grain size of about 30 μm to 40 μm are used to cut a similar workpiece at a low feed speed, thereby reducing a chipping size. In contrast, the ratio of the grain size of the boron compound grains to the grain size of the diamond abrasive grains is set to a predetermined range in Test 1 and Test 2, so that cutting can be performed at a high feed speed with a reduced chipping size, and the wear amount of the cutting blade 65 can also be suppressed. Accordingly, by using diamond abrasive grains having a grain size of 30 μm to 50 μm and adding boron compound grains having an average grain size of greater than ⅕ to less than or equal to ½ of the average grain size of the diamond abrasive grains in making the cutting blade, at least one of the increase in feed speed, the reduction in wear amount, and the suppression of chipping on the back side of the workpiece can be attained.

In the case of cutting a substrate having a thickness greater than 1 mm, there is a consensus for persons skilled in the art that the width of each division line S must be set to at least 200 μm to 250 μm in consideration of the size of chipping on the back side of the substrate. In this case, by using diamond abrasive grains having a grain size of about 70 μm to 80 μm as main abrasive grains and adding boron compound grains having a grain size (average grain size) of greater than ⅕ to less than or equal to ½ of the grain size (average grain size) of the diamond abrasive grains, in consideration of the trade-off between the feed speed of the workpiece and the wear rate of the cutting blade 65, it can be expected that the lubricity of the cutting blade can be improved and the chipping on the back side of the workpiece can be suppressed with an increased feed speed.

Thus, the lubricity of the cutting blade 65 can be improved by mixing boron compound grains such as $B_4C$ grains and cBN grains into diamond abrasive grains. Accordingly, even when the grain size of the diamond abrasive grains is increased to 70 μm to 80 μm at the maximum, the size of chipping on the back side of the workpiece can be suppressed to the same level as that in the prior art (the size of chipping generated in the case of using diamond abrasive grains having a small grain size of about 50 μm to 60 μm). Further, by using diamond abrasive grains having a grain size larger than that in the prior art and mixing boron compound grains into the diamond abrasive grains, the feed speed of the workpiece can be increased and the wear amount of the cutting blade can also be suppressed.

The present invention is not limited to the details of the above described preferred embodiment. The scope of the invention is defined by the appended claims and all changes and modifications as fall within the equivalence of the scope of the claims are therefore to be embraced by the invention.

What is claimed is:

1. A cutting blade including diamond abrasive grains and boron compound grains for cutting a quartz substrate or a glass substrate, wherein:

an average grain size of said diamond abrasive grains falls within the range of greater than or equal to 30 μm and less than or equal to 40 μm;

an average grain size of said boron compound grains is greater than 6 μm and less than or equal to 20 μm;

said diamond abrasive grains and said boron compound grains are fixed by a resin bond or a metal bond, and a percent volume of each said diamond abrasive grains and said boron compound grains in said resin bond or said metal bond is 10% to 20%; and wherein a ratio of the average grain size of said diamond abrasive grains and the average grain size of said boron compound grains configures the cutting blade to cut into a surface of the quartz substrate or the glass substrate.

2. The cutting blade according to claim 1, wherein said boron compound grains are selected from the group consisting of boron carbide ($B_4C$) grains and cubic boron nitride (cBN) grains.

3. The cutting blade according to claim 1, wherein a volume ratio between said diamond abrasive grains and said boron compound grains in said cutting blade is in a range between 2:1 to 1:8.

4. The cutting blade according to claim 1, wherein the cutting blade has an annular shape.

5. The cutting blade according to claim 4, wherein said diamond abrasive grains and said boron compound grains are fixed by the resin bond into a mixture which is pressed to form said annular shape and sintered at 180° C. to 200° C.

6. The cutting blade according to claim 4, wherein said diamond abrasive grains and said boron compound grains are fixed by the metal bond into a mixture which is pressed to form said annular shape and sintered at 600° C. to 700° C.

7. A cutting blade including diamond abrasive grains and boron compound grains for cutting a quartz substrate or a glass substrate, wherein:

an average grain size of said diamond abrasive grains falls within the range of greater than 40 μm to less than 50 μm; and an average grain size of said boron compound grains is greater than 8 μm and less than or equal to 25 μm;

said diamond abrasive grains and said boron compound grains are fixed by a resin bond or a metal bond, and a percent volume of each said diamond abrasive grains and said boron compound grains in said resin bond or said metal bond is 10% to 20%; and wherein a ratio of the average grain size of said diamond abrasive grains and the average grain size of said boron compound grains configures the cutting blade to cut into a surface of the quartz substrate or the glass substrate.

* * * * *